US005816565A

United States Patent [19]

McGuffin

[11] Patent Number: 5,816,565

[45] Date of Patent: Oct. 6, 1998

[54] HYDRAULIC BLOWOUT PREVENTER LIFTER

[75] Inventor: Martin H. McGuffin, Houston, Tex.

[73] Assignee: M Torque, Inc., Houston, Tex.

[21] Appl. No.: 794,973

[22] Filed: Feb. 5, 1997

[51] Int. Cl.[6] ..... B66F 1/00

[52] U.S. Cl. ..... 254/386; 254/385

[58] Field of Search ..... 254/386, 385; 166/85.4, 77.51

[56] References Cited

U.S. PATENT DOCUMENTS

| | | | |
|---|---|---|---|
| 172,650 | 1/1876 | Perkins | 254/386 |
| 181,113 | 8/1876 | Stebins | 254/386 X |
| 189,424 | 4/1877 | Brewer | 254/386 |
| 192,116 | 6/1877 | Fletcher | 254/386 |
| 267,489 | 11/1882 | Butz | 254/386 |
| 1,188,760 | 6/1916 | Hagenbucher | 254/386 |
| 2,984,455 | 5/1961 | Fischer | 254/172 |
| 3,368,619 | 2/1968 | Postlewaite | 166/0.6 |
| 3,456,745 | 7/1969 | Peri | 175/5 |
| 3,494,491 | 2/1970 | Sumida | 254/386 X |
| 3,517,737 | 6/1970 | Petersen | 166/0.6 |
| 3,891,038 | 6/1975 | Delestrade et al. | 175/7 |
| 4,125,164 | 11/1978 | Terry | 166/315 |
| 4,236,695 | 12/1980 | Morrison | 254/386 X |
| 4,305,467 | 12/1981 | Villines | 166/385 |
| 4,455,118 | 6/1984 | Schart | 254/386 X |
| 4,516,478 | 5/1985 | Connelly | 254/386 X |
| 4,651,652 | 3/1987 | Wyckoff | 254/386 X |
| 4,801,126 | 1/1989 | Rosman | 254/386 X |
| 4,917,566 | 4/1990 | Chauvin | 254/386 X |
| 5,467,833 | 11/1995 | Crain | 175/52 |

FOREIGN PATENT DOCUMENTS

| | | | |
|---|---|---|---|
| 210644 | 9/1957 | Australia | 254/385 |
| 2163 | of 1906 | United Kingdom | 254/386 |

*Primary Examiner*—Donald P. Walsh
*Assistant Examiner*—Emmanuel M. Marcelo
*Attorney, Agent, or Firm*—Pravel, Hewitt & Kimball

[57] ABSTRACT

A lifting apparatus for lifting a heavy object. The lifting apparatus including a frame assembly having a pair of side beams spaced parallel to one another. A sliding sheave assembly is mounted to the frame assembly. The sliding sheave assembly is positioned between the pair of side beams. The sliding sheave assembly has a first shaft with a plurality of first sheaves mounted thereto and a second shaft with a plurality of second sheaves mounted thereto. The first and second shafts are separated by a distance which can be varied. A cylinder has a first end connected to the frame assembly and a rod end attached to the sliding sheave assembly. The cylinder rod end is capable of moving longitudinally relative to the first end to thereby alter the distance between the first and second shafts. A cable having first and second ends attached to the frame assembly is reeved between the pluralities of first and second sheaves. A portion of the cable is reeved to a snatch block having a lifting hook for attaching to the heavy object. The heavy object is lifted by extending the rod end of the cylinder to increase the distance between the first and second shafts.

14 Claims, 8 Drawing Sheets

HYDRAULIC BLOWOUT PREVENTER LIFTER

BACKGROUND OF THE INVENTION

1. Field of the Invention

The present invention relates to lifting devices and more particularly to a hydraulic lifting device for lifting a blowout preventer from a wellhead.

2. Description of the Related Art

Blowout preventers, referred to in the oil and gas industry as "BOPs," are used to prevent blowouts during the drilling and production of oil and gas wells. The BOP is installed at the wellhead for the purpose of preventing the escape of pressure in an annular space between the casing and drill pipe, or in an open hole during drilling and completion operations. During the drilling operation from a drilling platform, the BOP is located some distance below the drilling rig floor. The drilling platform includes a rotary table which is mounted within a circular opening in the floor. The rotary table is used to turn the drill stem and support the drilling assembly.

The BOP is mounted on top of the well casing through which the drill string passes. BOPs are massive structures, weighing in excess of 45 tons in some drilling operations. The BOPs extend from the top of the casing to within a short distance of the bottom of the drilling platform.

At various times during the drilling of a well, it may become necessary to lift the BOP from the casing to allow access to the interior of the casing. Typically, the BOP is lifted approximately 12–18 inches above the wellhead.

In the past, BOPs have been lifted by using a plurality of hydraulic jacks suspended from the bottom of the drilling platform. It has also been common in the past to mount pulley systems to the underside of the drilling platform or to install a plurality of come-alongs having a handle which must be manipulated by a worker standing on a catwalk. These practices are dangerous and often times result in an unstable suspension of a very heavy BOP.

U.S. Pat. No. 4,125,164 to Terry discloses a plurality of hydraulic rams, which are connected to a BOP and the underside of the rig floor. The hydraulic rams are operated by an operator a safe distance from the BOP through the use of a portable fluid-distributing valve and pump assembly.

U.S. Pat. No. 4,305,467 to Villines discloses an apparatus for lifting a BOP, which is positioned on top of the rig floor and above the rotary table of the drilling platform. The apparatus includes a pair of winches with cables for lifting the BOP.

It is desirable to have a stack lifter for a blowout preventer which can be easily installed on top of the rig floor and which will vertically raise and lower the BOP. It is further desirable to have a stack lifter with sufficient capacity to raise and lower massive BOPs, and do this in a stable and upright manner. It is also desirable that the stack lifter be extremely safe and economical to use and install.

BRIEF SUMMARY OF THE INVENTION

The present invention is a stack lifting apparatus for a BOP which can be easily installed on top of the rig floor and which will vertically raise and lower the BOP. The stack lifting apparatus has sufficient capacity to raise and lower massive BOPs, and is capable of doing this in a stable and upright manner. The stack lifting apparatus is extremely safe and economical to use and easy to install.

The stack lifting apparatus includes a pair of lifting stand assemblies mounted on a base assembly. Each lifting stand assembly includes a frame assembly having a pair of side beams spaced parallel to one another. A sliding sheave assembly is mounted to the frame assembly and is positioned between the pair of side beams. The sliding sheave assembly has an idler shaft with a plurality of idler sheaves mounted thereto and a working shaft with a plurality of working sheaves mounted thereto. The idler and working shafts are separated by a distance. A cylinder has a base end connected to the frame assembly and a rod end attached to the sliding sheave assembly. The cylinder rod end is capable of moving longitudinally relative to the base end to thereby alter the distance between the idler and working shafts.

The stack lifting apparatus also includes a cable storage spool assembly mounted to the frame assembly. A first end of a cable is attached to a rotable spool of the cable storage spool assembly and a cable second end is deadlined to the frame assembly. The cable is reeved between the pluralities of idler and working sheaves. A portion of the cable is reeved to a snatch block having a lifting hook for attaching to the heavy object to be lifted. The heavy object is lifted by extending the rod end of the cylinder to increase the distance between the idler and working shafts.

BRIEF DESCRIPTION OF THE VIEWS OF THE DRAWINGS

In order to more fully understand the drawings referred to in the detailed description of the present invention, a brief description of each drawing is presented, in which.

DETAILED DESCRIPTION OF THE INVENTION

Figure 1:
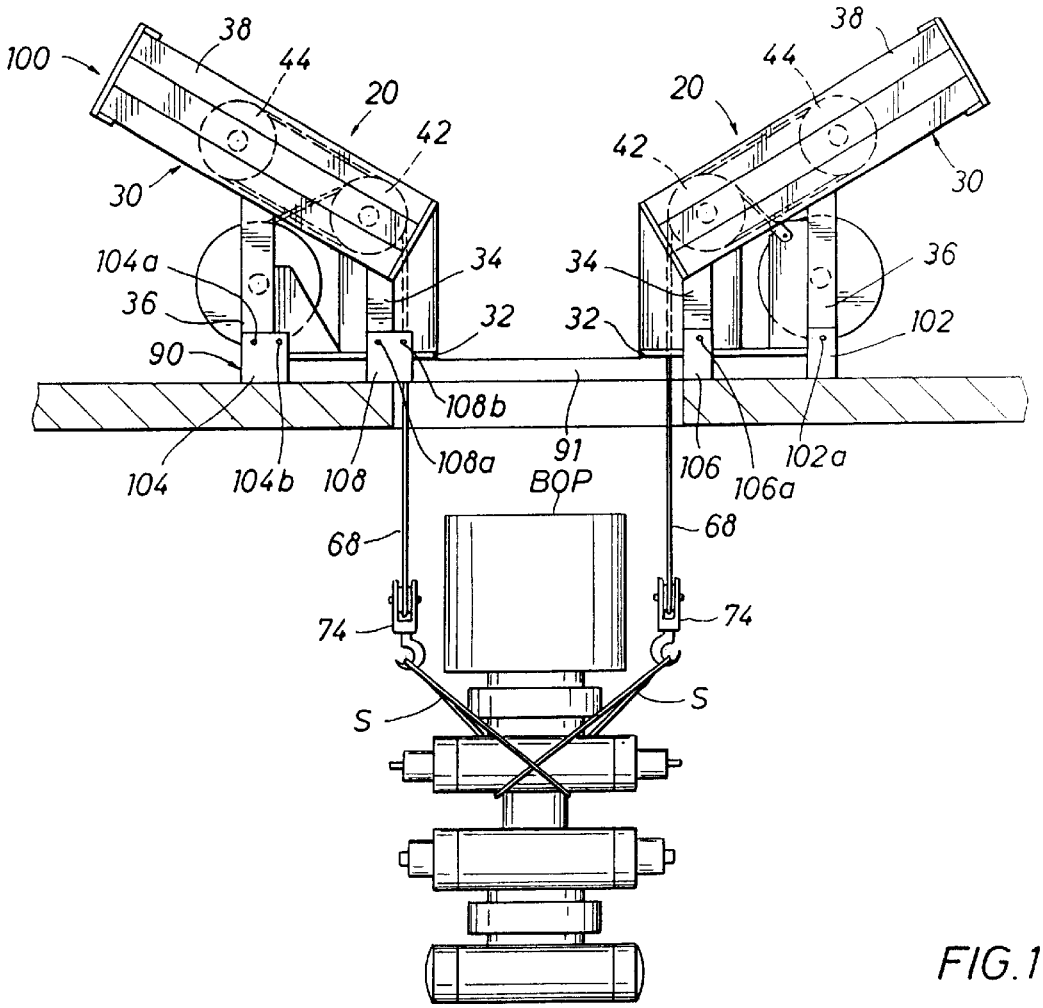
FIG. 1 is a side elevational view of the stack lifter apparatus according to a first embodiment of the present invention mounted on a platform and supporting a BOP.

Referring now to the drawings in greater detail, a stack lifter apparatus according to a first embodiment of the present invention, generally designated as 100, is shown in FIGS. 1–9. A stack lifter apparatus according to a second embodiment of the present invention, generally designated as 200, is shown in FIGS. 10–13.

Referring to FIG. 1, the stack lifter apparatus 100 includes a pair of lifting stand assemblies 20 mounted on a base assembly 90. The base assembly 90 is secured to the rig floor about the rotary table.

Referring to FIG. 1, the lifting stand assembly 20 includes a frame assembly 30. The frame assembly 30 includes a base plate 32 having a pair of front stanchions 34 and a pair of rear stanchions 36. Preferably, the front and rear stanchions 34 and 36, respectively, are vertical members and the rear stanchions 36 have a greater length than the front stanchions 34.

Figure 6:
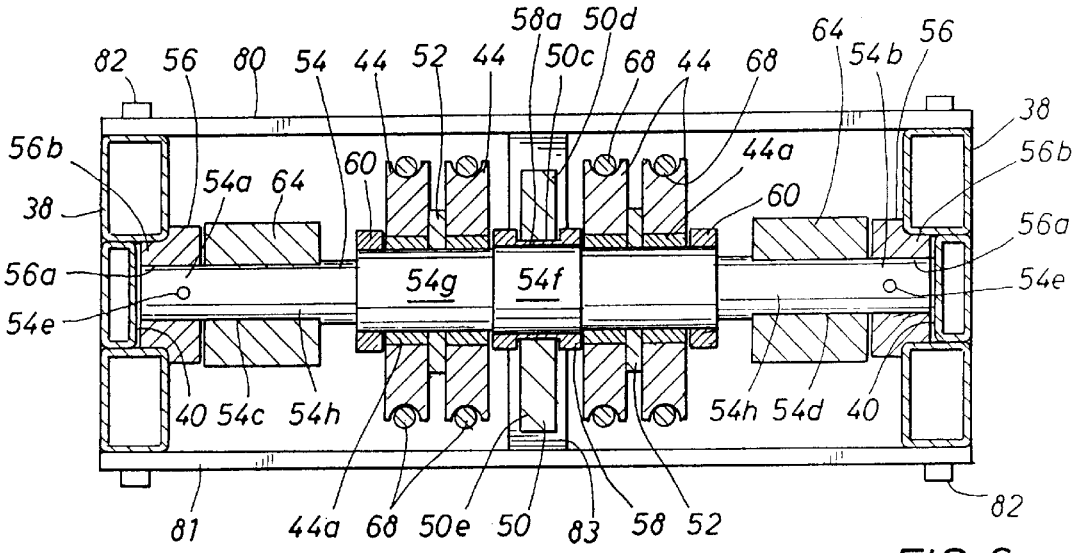
FIG. 6 is a sectional view taken along lines 6—6 of FIG. 3.
Figure 2:
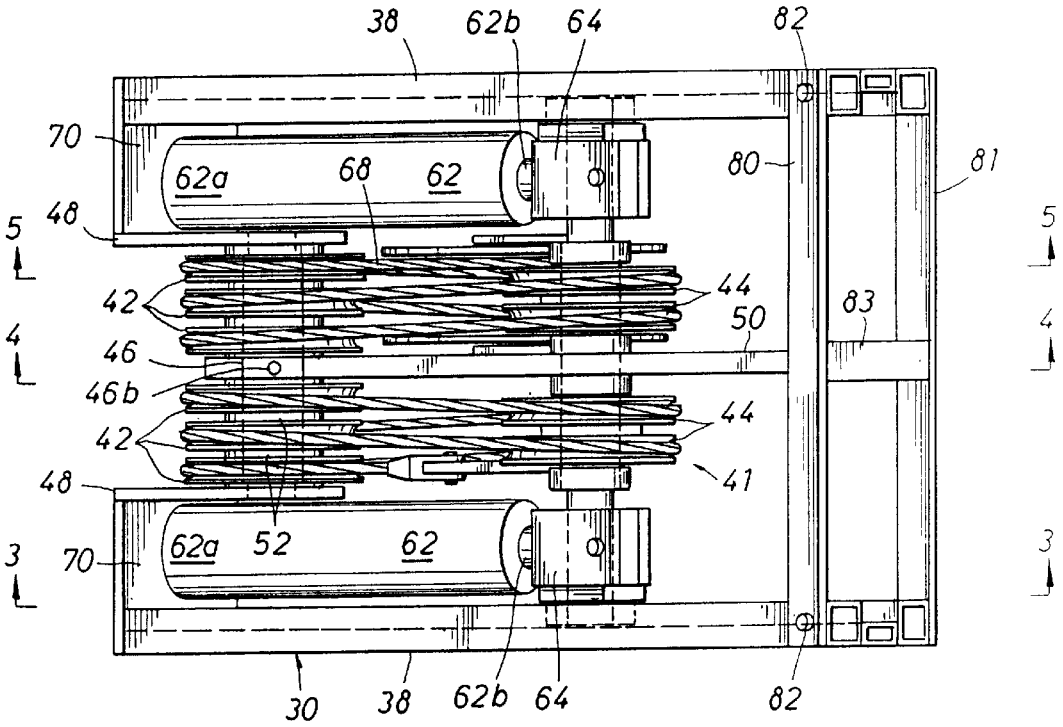
FIG. 2 is a top plan view of a lifting stand assembly of the stack lifter apparatus according to the first embodiment of the present invention.

Referring to FIGS. 1, 2 and 6, a pair of side beam assemblies 38 are mounted to the upper portions of the front and rear stanchions 34 and 36, respectively. Preferably, each side beam assembly 38 includes a longitudinal track 40 recessed within the side beam assembly 38 for reasons which will be explained below. Preferably, the side beam assembly 38 with the inner recessed track 40 is formed of rectangular steel tubing by welding a 6"–2" rectangular tube between a pair of 6"–4" rectangular tubes as shown in FIG. 6. Thus, the inner recessed track 40 has a height of approximately 6" and a depth of approximately 2" extending the length of the side beam assembly 38.

Figure 4:
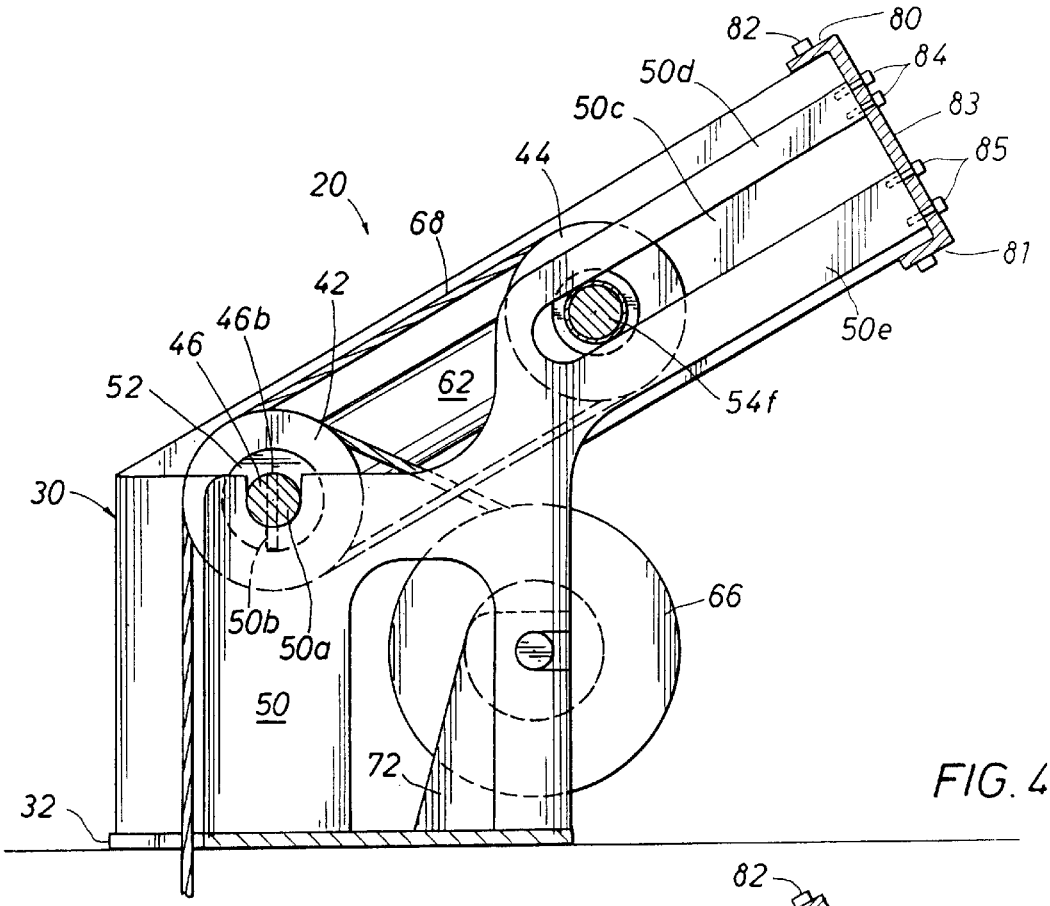
FIG. 4 is a sectional view taken along lines 4—4 of FIG. 2.
Figure 5:
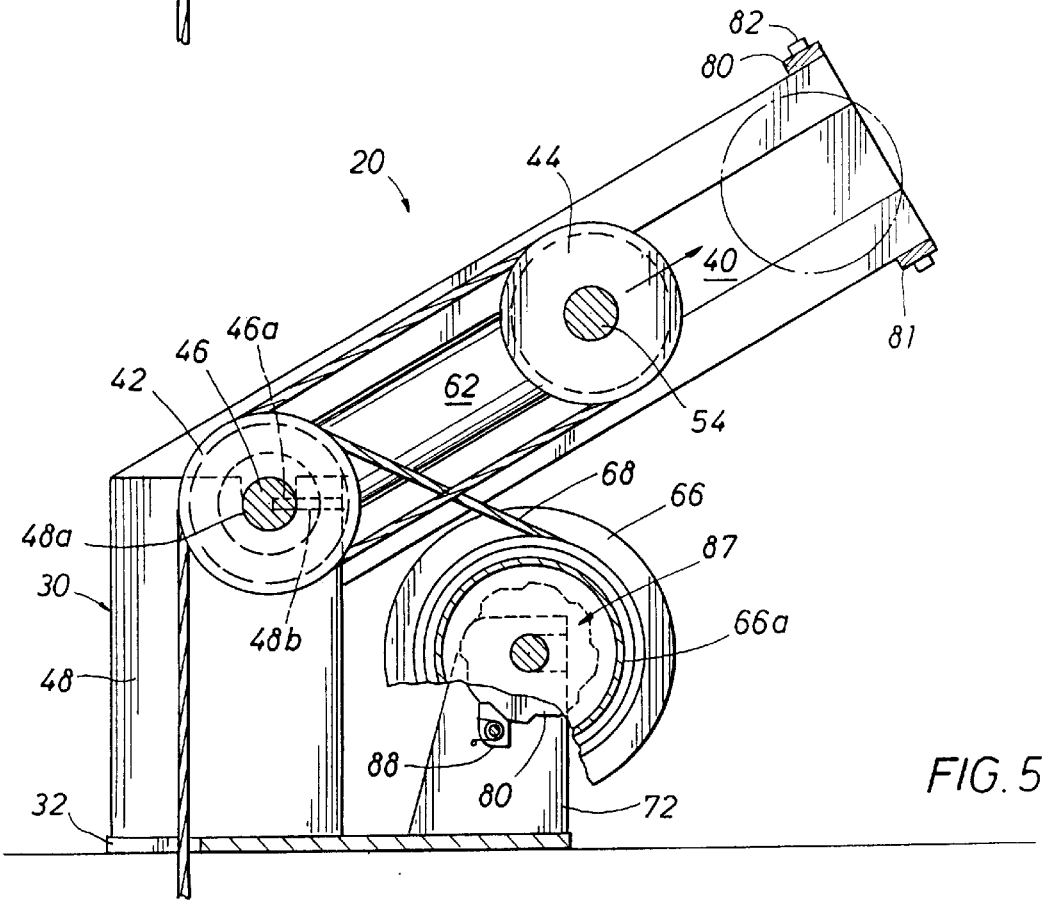
FIG. 5 is a sectional view taken along lines 5—5 of FIG. 2.

Referring to FIG. 2, the lifting stand assembly 20 includes a sliding sheave assembly 41. The sliding sheave assembly 41 includes a plurality of idler sheaves 42 and a plurality of working sheaves 44, as shown in FIG. 2. The idler sheaves 42 are rotatably mounted on an idler shaft 46, as shown in FIGS. 4 and 5. Preferably, the idler shaft 46 is a round shaft having a diameter of approximately 4". The idler shaft 46 includes first and second ends which are reeved in a shaft receptacle 48*a* formed in the upper end of a pair of retainer plates 48. The pair of retainer plates 48 are attached at their lower ends to the base plate 32. Preferably, the idler shaft 46 includes a threaded bore 46*a* (FIG. 5) at the first and second ends. Each retainer plate 48 preferably includes a bore 48*b* (FIG. 5), which is capable of aligning with the threaded bores 46*a* of the idler shaft 46. A threaded fastener (not shown) is inserted through the bore 48*b* and threaded into the threaded bore 46*a* of the idler shaft 46 to secure the idler shaft 46 to the retainer plate 48.

Referring to FIGS. 2 and 4, a guide plate 50 is centrally located on the base plate 32 and firmly secured, preferably by welding, to the base plate 32. The guide plate 50 includes an idler shaft recess 50*a* for vertically receiving the idler shaft 46. The idler shaft 46 includes a centrally located transverse bore 46*b*, which aligns with a threaded bore 50*b* in the idler shaft recess 50*a*. When the idler shaft 46 is installed in the retainer plate 48 and the guide plate 50, a bolt (not shown) is inserted through the bore 46*b* and threaded into the threaded bore 50*b* of the idler shaft recess 50*a*. The idler shaft 46 is thus non-rotatably secured to the frame assembly 30.

Referring to FIG. 2, prior to securing the idler shaft 46 to the frame assembly 30, a plurality of idler sheaves 42, having a central bearing (not shown) with an inner diameter substantially corresponding to the diameter of the idler shaft 46, are slid onto the idler shaft 46. Preferably, a spacer 52 is inserted between each of the idler sheaves 42. In the first embodiment as shown in FIG. 2, three idler sheaves 42 are rotatably mounted on the idler shaft 46 on each side of the guide plate 50.

Figure 3:
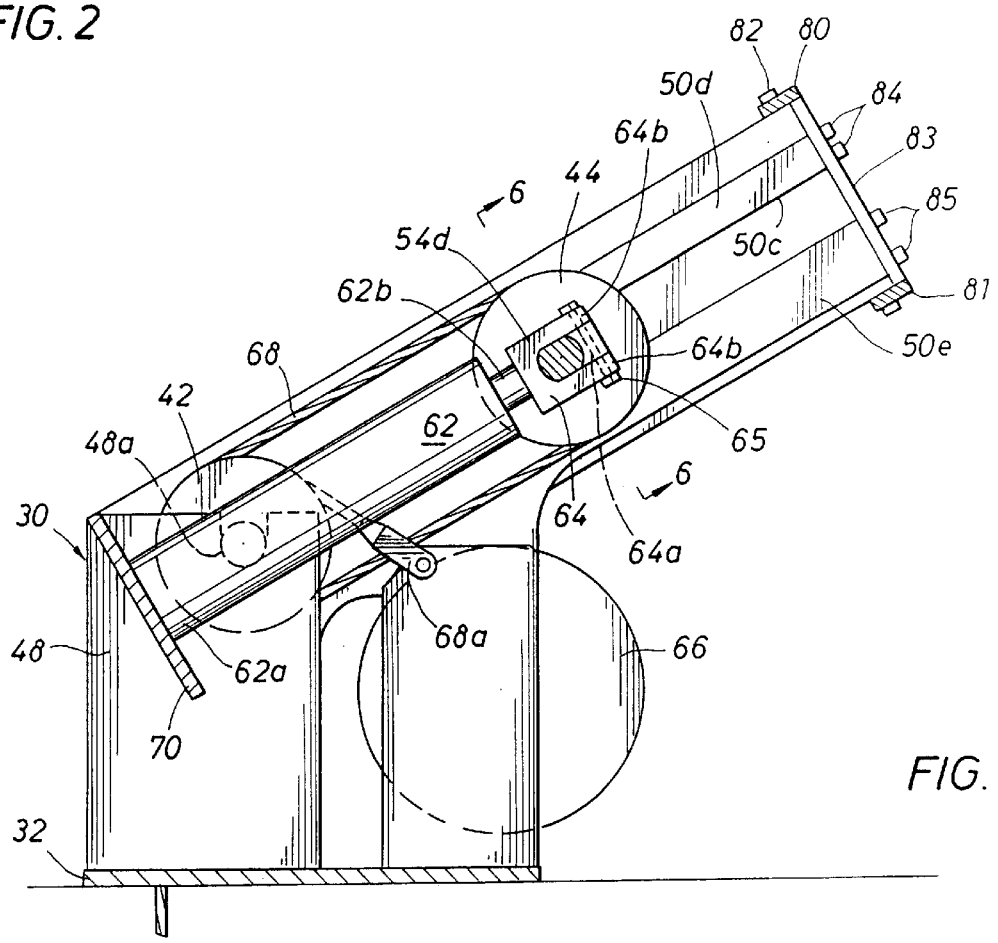
FIG. 3 is a sectional view taken along lines 3—3 of FIG. 2.

The plurality of working sheaves 44 are rotatably mounted on a working shaft 54, as shown in FIGS. 2 and 6. The working shaft 54 is a substantially round steel shaft having a first end 54*a* and a second end 54*b*. Referring to FIGS. 3 and 6, the first and second ends 54*a* and 54*b*, respectively, include a pair of flat surfaces 54*c* and 54*d*, respectively. The working shaft ends 54*a* and 54*b* are reeved in a pair of slide bars 56. Each slide bar 56 includes a central opening 56*a*, shaped to matingly receive the working shaft ends 54*a* and 54*b*. A pair of aligned through bores (not shown) extend through the slide bar 56 and intersect with the central opening 56*a*. The working shaft ends 54*a* and 54*b* include a transverse bore 54*e* which is capable of being aligned with the through bores (not shown) in the slide bar 56. A fastener, such as a pin or other suitable member, is inserted through the through bores and the aligned transverse bore 54*e* to secure the slide bar 56 to the working shaft 54. Referring to FIG. 6, the slide bar 56 includes a tracking extension 56*b*, which is sized to be slidably reeved within the recessed track 40 of the side beam assembly 38.

Referring to FIGS. 4 and 6, the centrally located guide plate 50 includes an elongated slot 50*c*, which is sized to slidably receive a central portion 54*f* of the working shaft 54. The elongated slot 50*c* is defined by an upper arm 50*d* and a lower arm 50*e* as shown in FIGS. 3, 4 and 6.

As shown in FIGS. 2–4 and 6, the frame assembly 30 includes upper and lower spacer bars 80 and 81, respectively, which are fastened, preferably with bolts and nuts 82, to the side beam assemblies 38. An end plate 83 is attached to the spacer bars 80 and 81, preferably by welding. Referring to FIGS. 3 and 4, a pair of bolts 84 extend through the end plate 83 and into the upper arm 50*d*. A pair of bolts 85 extend through the end plate 83 and into the lower arm 50*e*. The end plate 83 maintains alignment of the guide plate arms 50*d*, 50*e*.

Referring to FIG. 6, a roller guide 58 is slidably reeved onto the central portion 54*f* of the working shaft 54. The roller guide 58 has an inner diameter slightly greater than the outer diameter of the central portion 54*f*. Preferably, the inner surface of the roller guide 58 includes a groove (not shown) to provide lubrication between the roller guide 58 and the central portion 54*f* of the working shaft 54. The roller guide 58 includes an outer peripheral groove 58*a*, which is sized to be slidably received within the longitudinal slot 50*c* of the guide plate 50.

A plurality of working sheaves 44, having a central bearing 44*a* with an inner diameter substantially corresponding to the diameter of a sheave portion 54*g* of the working shaft 54, are slid onto the working shaft 54. In the first embodiment as shown in FIGS. 2 and 6, two working sheaves 44 are rotatably mounted on the working shaft 54 on each side of the guide plate 50. Preferably, a spacer 52 is inserted between the working sheaves 44.

Referring to FIG. 6, a sheave retainer 60 is sidably placed onto the working shaft 54 adjacent the outermost working sheaves 44 to secure the location of the working sheaves 44 on the working shaft 54.

Referring to FIGS. 2 and 3, a pair of hydraulic cylinders 62 have a body end 62*a* securely mounted to the frame assembly 30 by attaching a back plate 70 to the retainer plate 48. The hydraulic cylinder 62 has an extendable cylinder rod 62*b* having a clevis 64 attached thereto. Preferably, the hydraulic cylinder 62 has a stroke of 24" and a pressure rating of 5,000 pounds per square inch (psi). The clevis 64 includes a shaft receiving slot 64*a*, as shown in FIG. 3. The shaft receiving slot 64*a* is adapted to receive a shaft clevis portion 54*h*. The shaft clevis portion 54*h* includes the pair of opposing flat surfaces 54*c* and 54*d*, to correspond to the width of the shaft receiving slot 64*a* of the clevis 64. Referring to FIG. 3, the clevis 64 includes a pair of holes 64*b* through which a pin or other type of fastener 65 may be inserted to secure the working shaft 54 to the clevis 64.

Referring to FIGS. 3 and 4, it is to be understood that the hydraulic cylinders 62 are mounted parallel to the longitudinal slot 50*c* of the guide plate 50. It is also to be understood that the recessed tracks 40 of the side beam assemblies 38 are also parallel with the longitudinal slot 50*c* and the hydraulic cylinders 62. Thus, as the cylinder rods 62*b* of the hydraulic cylinders 62 extend and retract, they move along a line parallel with the longitudinal slot 50*c* and the recessed tracks 40. Therefore, the hydraulic cylinders 62 are utilized to alter the distance between the working shaft 54 and the idler shaft 46. As the cylinder rods 62*b* are extended, the working shaft 54 moves with the clevis 64. The slide bars 56 slidably travel in the recessed tracks 40 of the side beam assemblies 38. The central portion 54*f* of the working shaft 54 is received within the roller guide 58. The roller guide 58 slidably travels within the longitudinal slot 50*c*, which is contained within the outer peripheral groove 58*b* of the roller guide 58. Preferably, the hydraulic cylinders 62 are synchronized to one another.

A cable storage spool assembly 66 is supported by the guide plate 50 (FIG. 4) and a mounting plate 72 (FIG. 5) which is securedly mounted to the base plate 32. Preferably, the cable storage spool assembly 66 is below the side beam assembly 38. Preferably, the cable storage spool assembly 66 is hydraulically powered. A cable 68 is wrapped onto the cable storage spool assembly 66. Referring to FIG. 5, the cable storage spool assembly 66 includes a ratchet-type apparatus 87 having a spring-loaded pawl 88 which normally engages a sprocket 89 to allow rotation of a spool 66*a* in one direction while normally preventing rotation in the other direction. Preferably, the ratchet-type apparatus 87 freely allows spool take-up of the cable 68 while preventing the spool 66*a* rotation to reel cable 68 off of the spool 66*a*. When it is desired to reel cable 68 off of the spool 66*a*, the spring-biased pawl 88 is retracted to a position to allow the spool 66*a* to rotate in the necessary direction.

Figure 7:
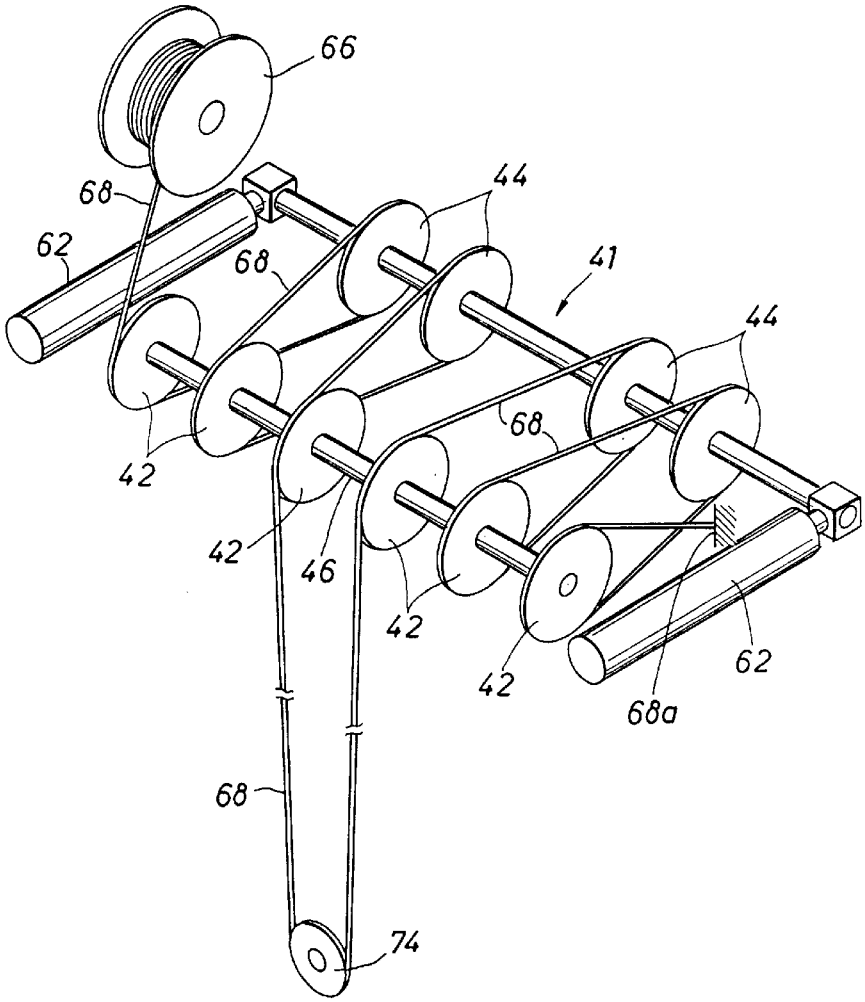
FIG. 7 is a schematic view of the sheaves and cable illustrating the lifting stand assembly with a pair of hydraulic cylinders in a first retracted position.
Figure 8:
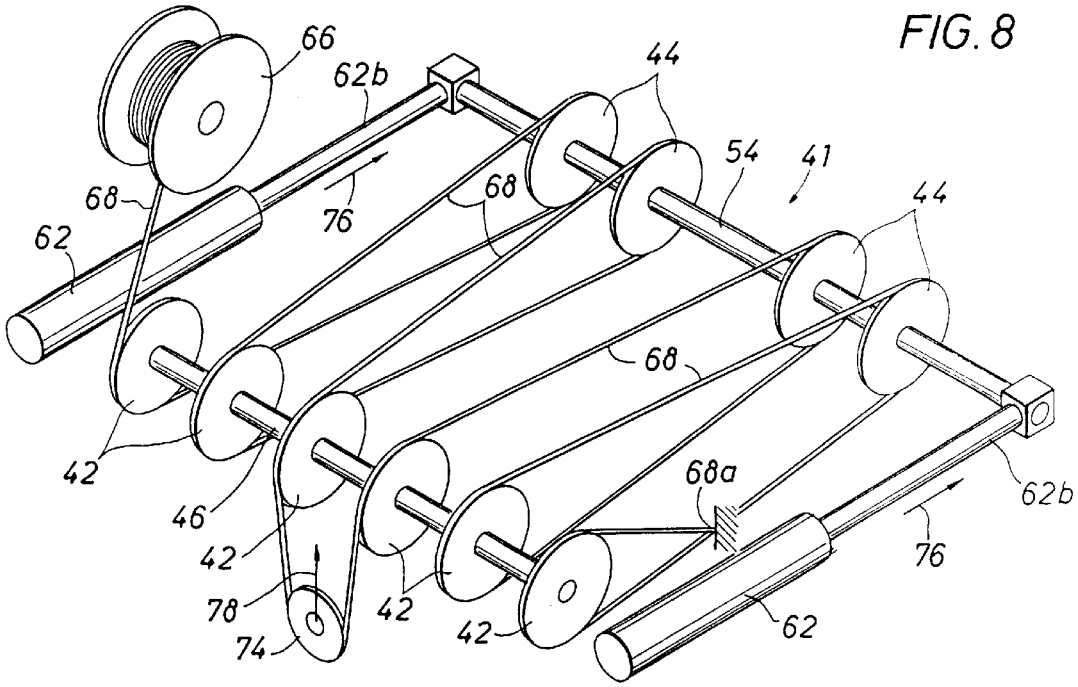
FIG. 8 is a schematic view of the sheaves and cable illustrating the lifting stand assembly with the pair of hydraulic cylinders in a second extended position.

The reeving of the cable 68 on the sliding sheave assembly 41 will now be described with reference to the schematic diagrams of FIGS. 7 and 8. It is to be understood that FIGS. 7 and 8 are merely illustrative and have been shown in this manner for clarity purposes. For example, the cable storage spool assembly 66 is shown positioned above the sliding sheave assembly 41 although it is actually positioned below the sliding sheave assembly 41 as shown in FIGS. 3–5 and as described above. Referring to FIG. 7, the cable 68 comes off of the cable storage spool assembly 66 and is reeved onto a first idler sheave 42 before passing to a first working sheave 44, then back to a second idler sheave 42, returning to a second working sheave 44 and finally back to a third idler sheave 44 located near the center of the idler shaft 46. The cable 68 then is reeved to a snatch block 74 by reeving the cable 68 around a pulley. From the snatch block 74, the cable 68 continues its winding path back and forth between the remaining idler and working sheaves 42 and 44, respectively, from the center to the outer portion of the sliding sheave assembly 41 until coming off of the last idler sheave 42. The cable end 68*a* is deadlined to the frame assembly 30 as shown in FIG. 3. Although not shown, it is preferable to deadline the cable end 68*a* by wrapping it a few times, for example 5 wraps, on a deadline spool (not shown) to alleviate the stress on the pinned end of the cable 68. It is to be understood that the cable 68 is preferably wire rope. It is also to be understood that the cable 68 is a single, continuous cable extending from the cable storage spool assembly 66 to the deadlined cable end 68*a*.

Preferably, the cable storage spool assembly 66 has a line storage capacity of about 100'. It is to be understood that the cable storage spool assembly 66 is utilized to provide the required amount of cable 68 and to adjust and take up excess cable since the distance between the platform floor and the BOP will vary from location to location. The cable storage spool assembly 66 is not used to raise or lower the BOP. The raising and lowering of the BOP is performed by the hydraulic cylinders 62 and the sliding sheave assembly 41.

Figure 9:
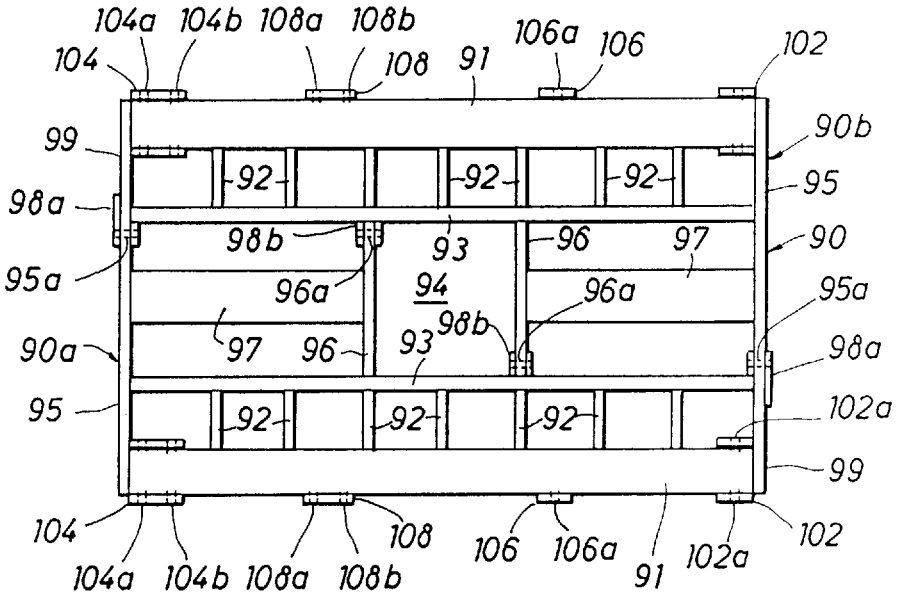
FIG. 9 is a top plan view of the base assembly of the stack lifter apparatus with the lifting stand assemblies removed for clarity.

The base assembly 90 includes a two-piece assembly which is referred to as first base subassembly 90*a* and second base subassembly 90*b* as shown in FIG. 9. The two-piece base assembly 90 is preferably pinned together, as will be explained below. It is to be understood that the first and second base subassemblies 90*a* and 90*b*, respectively, are substantially of identical construction, and thus, similar members will be given the same reference numbers.

Referring to FIGS. 1 and 9, the base subassembly 90*a*, 90*b*, includes an elongate tubular member 91 having a plurality of transverse stiffener members 92 weldably connected thereto. Preferably, the transverse stiffener members 92 are channel members made of steel. The transverse channel members 92 are also weldably connected to an elongate channel member 93 which defines one side of a central opening 94 through the base assembly 90. A first end channel 95 is secured to an end of the elongate tubular member 91 and an end of the elongate channel member 93. A hole 95*a* extends through the first end channel 95. A second end channel 99 is weldably connected to the elongate tubular member 91 and the elongate channel member 93. An interior channel 96 having a hole 96*a* is connected to the elongate channel member 93 to define another side of the central opening 94. A second tubular member 97 is weldably connected to the first end channel 95 and the interior channel 96. A couple of connecting devises 98*a* and 98*b* are weldably connected to the elongate channel member 93, as shown in FIG. 9. The connecting devises 98*a* and 98*b* include a hole therethrough.

As stated above, the first base subassembly 90*a* is pin-connected to the second base subassembly 90*b* and the second base subassembly 90*b* is similarly pin-connected to the first base subassembly 90*a*. Referring to FIG. 9, a first pin (not shown) extends through the aligned holes of the clevis 98*a* and the first end channel 95. A second pin (not shown) similarly extends through the aligned holes of the clevis 98*b* and the interior channel 96. It is to be understood that this construction and assembly of the base assembly 90 permits the base assembly 90 to be installed over the rotary table even with drill pipe extending up through the rig floor. This is a highly desirable feature of the present invention.

Referring to FIGS. 1 and 9, each base subassembly 90*a* and 90*b* includes a plurality of connector assemblies mounted to the elongate tubular member 91 for connecting the lifting stand assemblies 20 to the base assembly 90. The connector assemblies include a first connector clevis 102 mounted at one end of the elongate tubular member 91 and having a hole 102*a* extending through the first connector clevis 102. A second connector clevis 104 mounted at a second end of the elongate tubular member 91 includes a pair of holes 104*a* and 104*b* therethrough, as shown in FIG. 9. A first connector plate 106 is connected to the elongate tubular member 91 and has a hole 106*a* extending therethrough. A second connector plate 108 having a pair of holes 108*a* and 108*b* therethrough is also connected to the elongate tubular member 91.

Referring to FIG. 1, the front stanchions 34 of the lifting stand assemblies 20 include a hole (not shown) therethrough, which aligns with the hole 106*a* of the first connector plate 106 or the holes 108*a* and 108*b* of the second connector plate 108 to pin-connect the front stanchions 34 to the base assembly 90. The rear stanchions 36 similarly include a hole (not shown) therethrough which aligns with the hole 102*a* or the holes 104*a* and 104*b* to pin connect the rear stanchions 36 to the base assembly 90. It is to be understood that the pair of holes 104*a* and 104*b*, and the pair of holes 108*a* and 108*b* are provided to be able to adjust the spacing between the pair of lifting stand assemblies 20. Preferably, the desired spacing between the cables 68 of the lifting stand assemblies 20 is either approximately 18½" or 20½". Thus, the pairs of holes 104*a* and 104*b*, and 108*a* and 108*b*, provide the adjustment to obtain the desired distance between the cables 68.

FIGS. 1, 7 and 8 will be used to illustrate the raising and lowering operation of each lifting stand assembly 20. FIG. 7 shows the hydraulic cylinders 62 in a retracted position with the snatch block 74 lowered to the desired position. The snatch block 74 is initially lowered to the desired position by reeling the cable 68 off of the cable storage spool assembly 66 until a lifting sling S, which has been wrapped or secured around the BOP, can be hooked to the snatch block 74 as shown in FIG. 1. Once the lifting sling S has been hooked onto the snatch block 74, the cable storage spool assembly 66 is used to take up any extra slack in the cable 68. This procedure is followed for each of the lifting stand assemblies 20.

With reference to FIG. 8, the raising or lifting operation of the lifting stand assembly 20 will be explained. The hydraulic cylinders 62 have been extended or stroked in the direction of the arrow 76. As the hydraulic cylinders stroke in the direction of the arrow 76, the distance between the working shaft 54/working sheaves 44 and the idler shaft 46/idler sheaves 42 increases by the same distance.

In the stack lifter apparatus 100 as described above and as shown in the drawings, for a given amount of cylinder stroke, the snatch block 74 vertically travels in the direction of arrow 78 approximately 4 times (4X) this amount. This assumes that there is little slack initially in the cable 68 and that the cable 68 stretches little under the applied weight of the BOP. Thus, a 24" stroke of the hydraulic cylinders 62 results in approximately 96" or 8' of vertical lifting capability.

Referring to FIGS. 1, 7 and 8, it is also to be understood that the lifting of the BOP with the stack lifter apparatus 100 is performed by a pair of lifting stand assemblies 20 with each lifting stand assembly 20 comprising a double line for supporting the load. As shown in FIGS. 7 and 8, the cable 68 comes off one of the pair of innermost idler sheaves 42 and passes through the pulley of the snatch block 74 before returning to the other innermost idler sheave 74. The advantage this provides is that the double line running to the snatch block 74 remains uniformly positioned relative to the drilling rig floor opening. The pair of lifting stand assemblies 20 can be operated in tandem to provide a vertical lifting force centered about the rotary table. The present invention eliminates any lateral "travel" relative to the center of the rotary table which results as cable is winched onto a winch drum to lift objects.

The stack lifter apparatus 100 of the present invention provides a high capacity BOP stack lifting apparatus. For example, four hydraulic cylinders 62 (two on each lifting stand assembly 20) each having a rating of 5,000 psi will have a capacity 96 tons. It is expected that the lifting capacity of the stack lifter apparatus 100 will be a maximum of approximately 66 tons due to the strength of 1" cable 68. Preferably, each snatch block 74 has a 30 metric ton rating. It is to be understood that the hydraulic cylinders 62 provide a smooth and substantially shock-free system for raising and lowering the load. It is also to be understood that a single hydraulic cylinder could be used instead of the pair of cylinders 62. If a single cylinder is used, the cylinder would preferably be located on the central vertical plane of the lifting stand assembly 20.

It is also to be understood that the present invention is not limited to the specific number of idler and working sheaves 42 and 44, respectively, or to the specific reeving of the cable 68 on the sheaves 42 and 44 as described above and shown in the drawings. The preferred number of sheaves 42 and 44 and the reeving will be dependent on the design load requirements of the stack lifter apparatus 100.

Preferably, the hydraulic cylinders 62 are mounted in an inclined plane. Preferably, the hydraulic cylinders 62 are angled in the range of approximately 25° to 90° with respect to the base assembly 90. This minimizes the horizontal space required on the drilling rig floor which is always very limited.

The stack lifter apparatus according to the second embodiment of the present invention 200 will now be described in detail with reference to FIGS. 10–13. It is to be understood that the stack lifter apparatus 200 is similar to the stack lifter apparatus 100 in many respects. The base assembly 90 is the same in the first and second embodiments. The similar or identical elements between the two embodiments are referenced by the same two digit reference number. The new or modified elements in the stack lifter apparatus 200 have a three digit number beginning with 2. It is to be understood that similar or identical elements perform the same function in the stack lifter apparatus 200 as in the stack lifter apparatus 100 and only the new or modified elements are discussed below.

The stack lifter apparatus 200 includes a pair of lifting stand assemblies 220 mounted to the base assembly 90 as discussed above. The primary modification between the lifting stand assembly 220 and the lifting stand 20 involves the working shaft 54 and guide plate 50.

Figure 10:
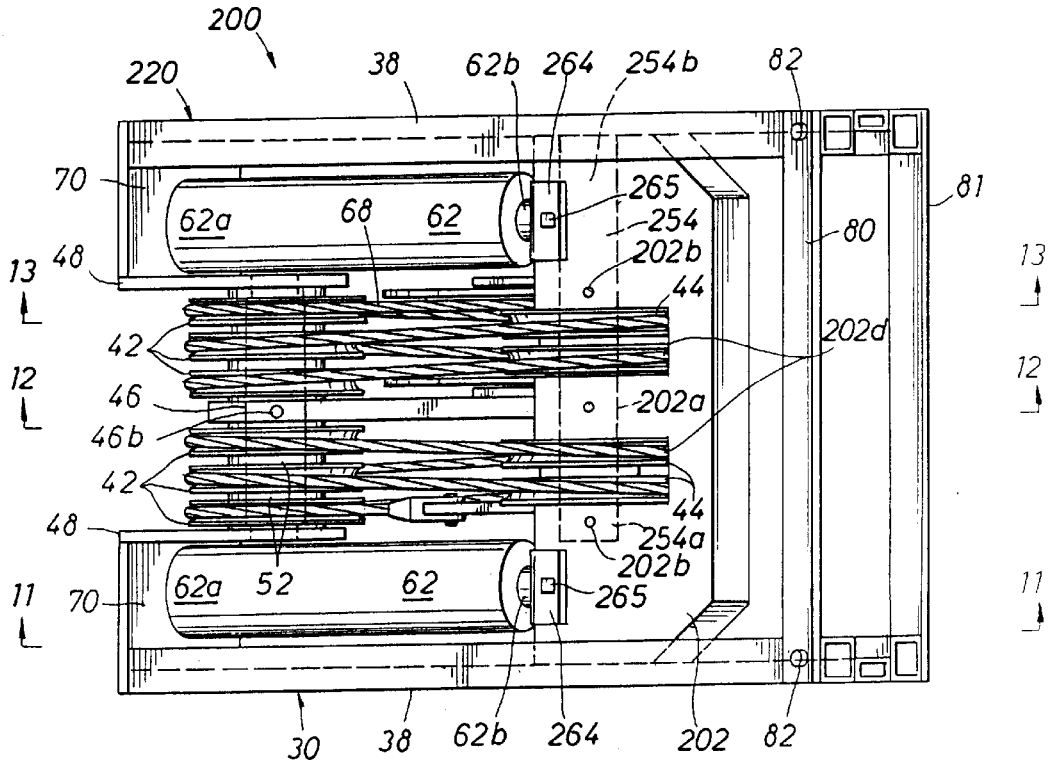
FIG. 10 is a top plan view of a lifting stand assembly of the stack lifter apparatus according to a second embodiment of the present invention.

Referring to FIG. 10, the plurality of working sheaves 44 are rotatably mounted on a working shaft 254. The working shaft 254 is a substantially round steel shaft having a first end 254*a* and a second end 254*b*. The working shaft 254 is received in a shaft bore 202*a* in a shaft support plate 202. The shaft support plate 202 includes a plurality of holes 202*b* intersecting the shaft bore 202*a*. The working shaft 254 includes a plurality of transverse blind bores 254*c* (FIG. 14) which align with the holes 202*b* in the shaft support plate 202. A plurality of fasteners (not shown), preferably threaded, can be inserted into the holes 202*b* and 254*c* to secure the working shaft 254 in position.

Figure 13:
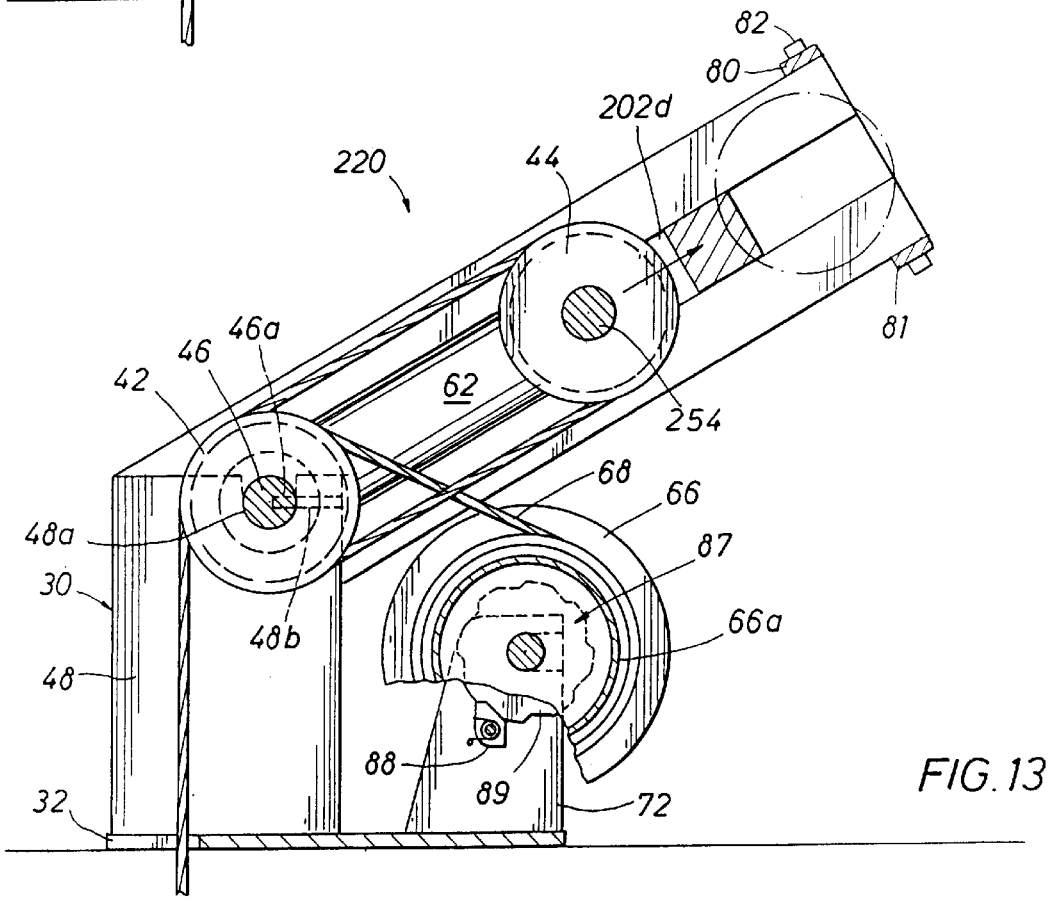
FIG. 13 is a sectional view taken along lines 13—13 of FIG. 10.
Figure 14:
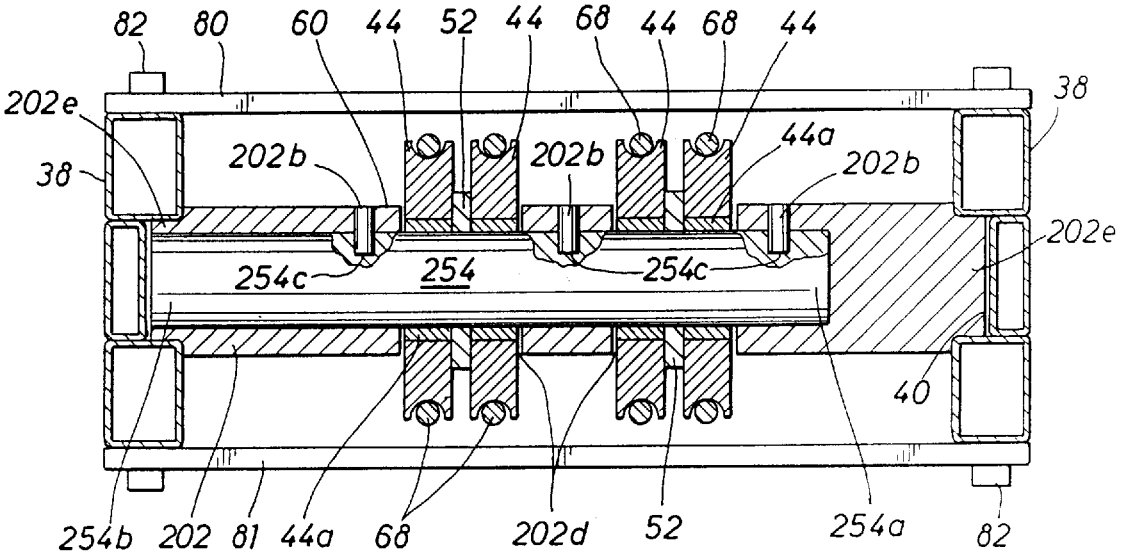
FIG. 14 is a sectional view taken along lines 14—14 of FIG. 11.

Referring to FIGS. 10, 13 and 14, the shaft support plate 202 includes a pair of sheave cut-outs 202*d* through which the working shaft 254 extends. The working sheaves 44 are mounted on the working shaft 254 as the working shaft 254 is inserted in the shaft bore 202*a* of the shaft support plate 202. The sheave cut-outs 202*d* are sized in width and depth to receive the desired number and size of working sheaves 44.

Referring to FIGS. 10 and 14, the shaft support plate 202 includes a pair of tracking extensions 202*e*, which are sized to be slidably received within the recessed tracks 40 of the side beam assemblies 38.

Figure 12:
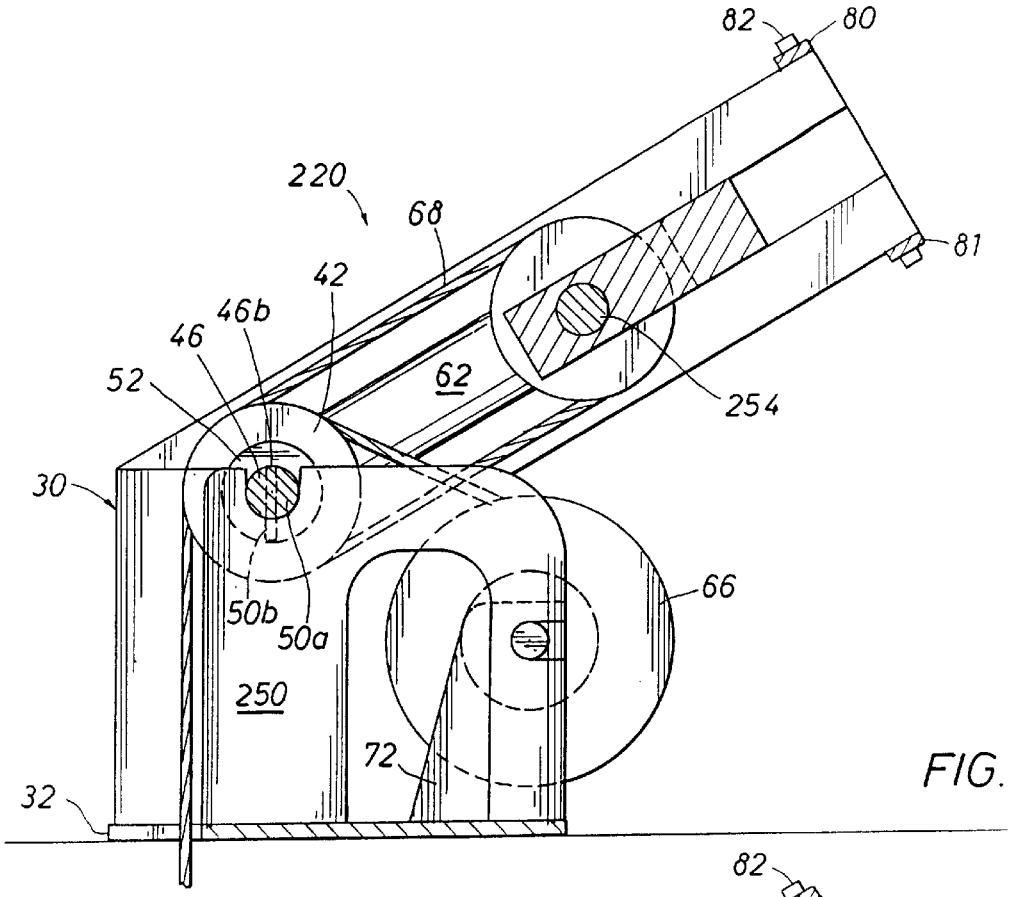
FIG. 12 is a sectional view taken along lines 12—12 of FIG. 10.

The centrally located guide plate 50 has been modified in the lifting stand assembly 220 by eliminating the elongated slot 50*c* defined by the upper and lower arms 50*d* and 50*e*, respectively (FIGS. 3, 4 and 6). The modified guide plate 250 is best shown in FIG. 12. The elongated slot 50*c* is not needed in the lifting stand assembly 200 as a result of the shaft support plate 202. The end plate 83 (FIGS. 2–4) has also been eliminated in the lifting stand assembly 200 to provide an open area for the passing of a portion of the shaft support plate 202 when in the extended position.

Figure 11:
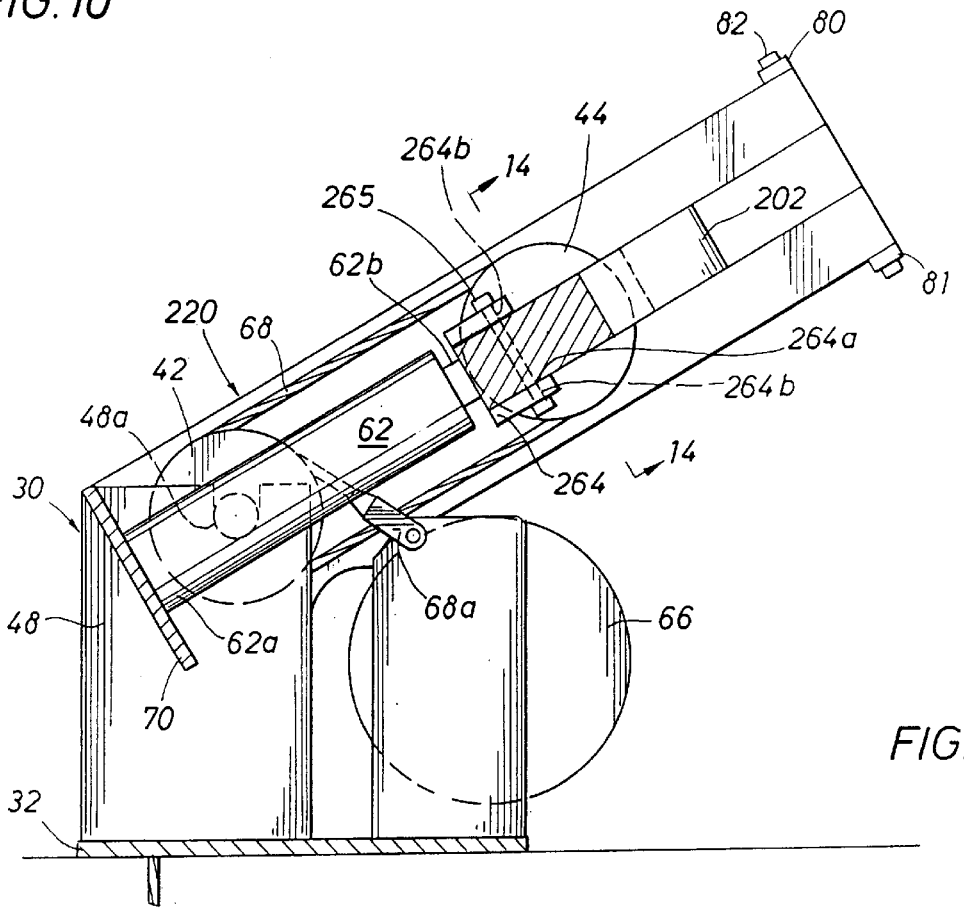
FIG. 11 is a sectional view taken along lines 11—11 of FIG. 10.

The hydraulic cylinder 62 has an extendable cylinder rod 62*b* having a clevis 264 attached thereto. Preferably, the hydraulic cylinder 62 has a stroke of 24" and a pressure rating of 5,000 pounds per square inch (psi). The clevis 264 includes an opening 264*a*, generally rectangular, for receiving a forward portion of the shaft support plate 202 as shown in FIG. 11. Referring to FIG. 11, the clevis 264 includes a pair of aligned holes 264*b* through which a pin or other type of fastener 265 may be inserted to secure the shaft support plate 202 to the clevis 264.

It is to be understood that the function and operation of the lifting stand assemblies 220 and the lifting stand assemblies 20 are the same. The lifting stand assembly 220 shown in FIGS. 10–14 provides greater support to the working shaft 254 and reduces the bending moments and stresses in the working shaft 254. Thus, the stack lifter apparatus 200 is capable of lifting even greater loads than the stack lifter apparatus 100. However, in many instances either embodiment will work satisfactorily and will provide operational and safety advantages discussed above which are not presently available in other devices of a similar nature.

Having described the invention above, various modifications of the techniques, procedures, material and equipment will be apparent to those in the art. It is intended that all such variations within the scope and spirit of the appended claims be embraced thereby.

What is claimed is:

1. A lifting apparatus for lifting a heavy object, the lifting apparatus comprising:

a frame assembly;

a sliding sheave assembly having a first shaft with a plurality of first sheaves mounted thereto and a second shaft with a plurality of second sheaves mounted thereto, said first shaft mounted to said frame assembly and said first and second shafts separated by a distance;

a cylinder having a first end connected to said frame assembly and a second end coupled to said second shaft of said sliding sheave assembly, wherein said second end is capable of moving longitudinally relative to said first end to thereby alter the distance between said first shaft and said second shaft;

a cable storage spool assembly mounted to said frame assembly;

a cable having a first end and a second end, said first cable end attached to said cable storage spool assembly and said second cable end attached to said frame assembly, said cable reeved between said pluralities of first and second sheaves, a portion of said cable reeved to a snatch block having a lifting hook for attaching to the heavy object, wherein the heavy object is lifted by extending said second end of said cylinder to increase the distance between said first and second shafts.

2. The lifting apparatus of claim 1, wherein said plurality of first sheaves are rotatably mounted to said first shaft and said plurality of second sheaves are rotatably mounted to said second shaft.

3. The lifting apparatus of claim 1, wherein said first and second shafts are non-rotatably mounted to said frame assembly.

4. The lifting apparatus of claim 1, wherein said frame assembly includes a pair of side beams spaced parallel to one another and said sliding sheave assembly is positioned between said pair of side beams.

5. The lifting apparatus of claim 1, wherein said sliding sheave assembly is in an inclined plane.

6. A stack lifting apparatus for lifting a blowout preventer, the stack lifting apparatus comprising a pair of lifting stand assemblies, each said lifting stand assembly comprising:

a frame assembly;

a translating sheave assembly having a first shaft with a plurality of first sheaves mounted thereto and a second shaft with a plurality of second sheaves mounted thereto, said first shaft mounted to said frame assembly and said first and second shafts separated by a distance;

a pair of hydraulic cylinders, each said hydraulic cylinder having a first end coupled to said frame assembly and a second end coupled to said second shaft of said translating sheave assembly, each said hydraulic cylinder having an extendable rod end capable of altering the distance between said first shaft and said second shaft;

a cable storage spool assembly mounted to said frame assembly;

a cable having a first end and a second end, said first cable end attached to said cable storage spool assembly and said second cable end attached to said frame assembly, said cable reeved between said pluralities of first and second sheaves, a portion of said cable reeved to a snatch block having a lifting hook for attaching to the heavy object, wherein the heavy object is lifted by extending said cylinder rod ends to increase the distance between said first and second shafts.

7. The stack lifting apparatus of claim 6, wherein said rod ends are connected to said second shaft.

8. The stack lifting apparatus of claim 6, wherein said plurality of first sheaves are rotatably mounted to said first shaft and said plurality of second sheaves are rotatably mounted to said second shaft.

9. The stack lifting apparatus of claim 8, wherein said first shaft is non-rotatably mounted to said frame assembly.

10. The stack lifting apparatus of claim 6, each said lifting stand assembly further comprising a guide plate mounted to said frame assembly, said guide plate having an elongated slot to permit movement of said second shaft.

11. The stack lifting apparatus of claim 6, further comprising a base assembly, said pair of lifting stand assemblies connected to said base assembly.

12. A hydraulic lifting apparatus for lifting a heavy object, the lifting apparatus comprising:

a frame assembly having a pair of side beams spaced parallel to one another;

a first shaft mounted to said frame assembly between said pair of side beams;

a plurality of first sheaves mounted to said first shaft;

a second shaft slidably mounted to said pair of side beams;

a plurality of second sheaves mounted to said second shaft, wherein said first and second shafts are parallel to one another and are separated by a variable distance;

at least one hydraulic cylinder having an extendable cylinder rod and a rod end, said extendable cylinder rod connected to said second shaft, wherein said hydraulic cylinder is capable of varying the distance between said first and second shafts;

a cable storage spool assembly mounted to said frame assembly;

a cable having a first end and a second end, said first cable end of said cable attached to said cable storage spool assembly and said second cable end attached to said frame assembly, said cable reeved between said pluralities of first and second sheaves, a portion of said cable reeved to a snatch block having a lifting hook for attaching to the heavy object, wherein the heavy object is lifted by extending said extendable cylinder rod to increase the distance between said first and second shafts.

13. The lifting apparatus of claim 12, wherein said plurality of first sheaves are rotatably mounted to said first shaft and said plurality of second sheaves are rotatably mounted to said second shaft.

14. The lifting apparatus of claim 12, wherein said first and second shafts are non-rotatably mounted to said frame assembly.

* * * * *